United States Patent [19]

Botte

[11] 4,114,871

[45] Sep. 19, 1978

[54] COLLATION CONTROLS

[75] Inventor: Anthony Joseph Botte, Boulder, Colo.

[73] Assignee: International Business Machines Corporation, Armonk, N.Y.

[21] Appl. No.: 794,327

[22] Filed: May 5, 1977

[51] Int. Cl.[2] ..... B65H 39/10

[52] U.S. Cl. ..... 271/173

[58] Field of Search ..... 271/173, 64, 265

[56] References Cited

U.S. PATENT DOCUMENTS

| | | | |
|---|---|---|---|
| 3,347,367 | 10/1967 | Smith | 271/173 X |
| 3,927,878 | 12/1975 | Bolsenga | 271/173 |
| 3,995,748 | 12/1976 | Looney | 271/173 X |
| 3,998,450 | 12/1976 | Howard | 271/173 |
| 4,026,539 | 5/1977 | Knoops | 271/173 |
| 4,055,339 | 10/1977 | Looney | 271/173 |

*Primary Examiner*—Richard A. Schacher

*Attorney, Agent, or Firm*—Herbert F. Somermeyer

[57] ABSTRACT

A copy production machine having a document feed and a collator controls collator operation for optimum performance in accordance with the status of the original document feed. The collator has a construction such that collation of a moving vane in a first relative direction with respect to a set of collator bins provides more reliable collation operation for enhancing throughput. When an original document is in a position to be copied upon the ending of a current copy production run, collation occurs in both directions of relative motion, whereas in the absence of such original document in the document feed position, collation only occurs in the preferred direction. In other aspects of the invention, whenever copies from multiple images are simultaneously being processed by the copy production machine, collation occurs in both directions of collation, whereas when copies bear images of a single image then collation only occurs in the preferred direction.

10 Claims, 5 Drawing Figures

FIG. 1
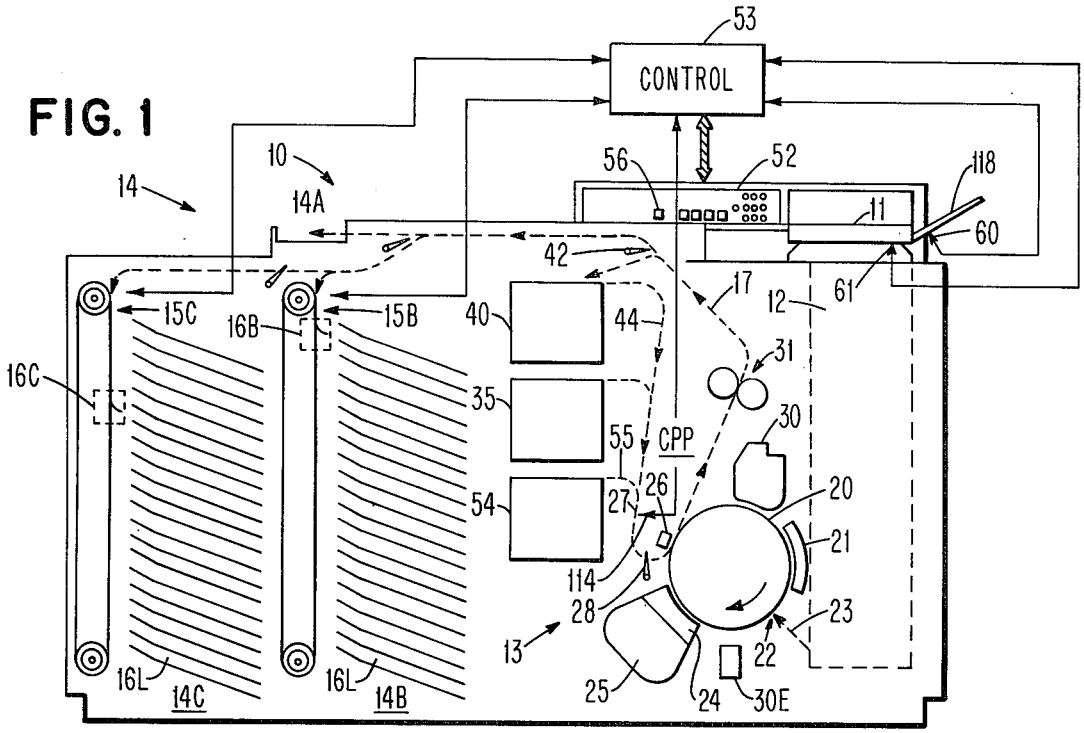
FIG. 2
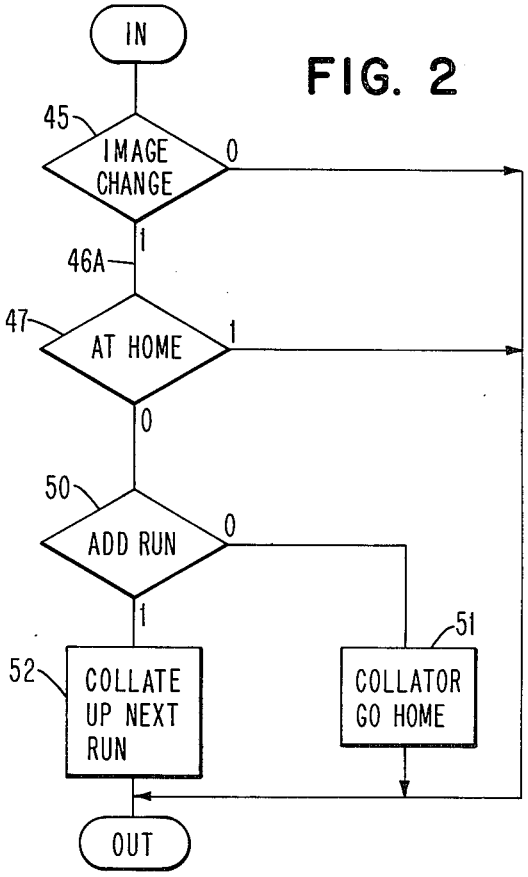
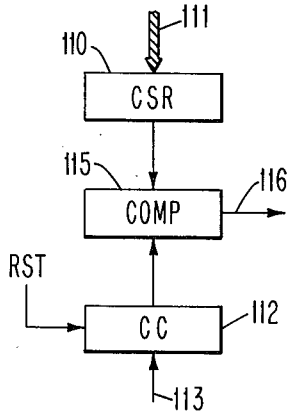
FIG. 5

COLLATION CONTROLS

DOCUMENTS INCOPORATED BY REFERENCE

Co-pending commonly assigned U.S. application Ser. No. 636,252 filed Nov. 28, 1975 in the name of Ralph J. LeClere now U.S. Pat. No. 4,026,543 is incorporated for its showing of collator control circuits.

Co-pending commonly assigned U.S. application Ser. No. 729,453, filed Oct. 4, 1976 in the name of Wallace L. Hubert and entitled "Copy Production Machine Having a Duplex Mode" shows microprocessor construction with which the microcode in this disclosure can be executed.

U.S. Pat. No. 4,003,569 shows detection of a last copy.

BACKGROUND OF THE INVENTION

The present invention relates to copy production machines having collation apparatus and particularly into a control aspect of a collator in a copy production machine having document feeding means.

Copy production machines, including convenience copiers, often have a semiautomatic document feed (SADF) or an automatic document feed (ADF) which semi-automatically or automatically supplies original documents to be copied to an imaging area. A copy production portion (CPP) responds to the image presented by the original document in the imaging position to produce copies. The copies often can be supplied to a simple exit tray or to an automatic collation apparatus. In the latter, sets of documents can be conveniently reproduced.

It is also highly desirable that the copy production rate be maximized under certain conditions; i.e., reduce the total time required to make a set of documents. In this regard, most collators have a preferred direction of collation. That is, for jam control purposes and jam avoidance it is desired that the collator operates from a so-called home position and collate when the relative movement is away from the home position. Upon completion of one collating run the collator moves back to the home position in preparation of the next run. While reliable operation may be enhanced by this type of function, throughput is penalized in that the copy production machine must wait for the collator to reset to the home position.

Collators come in various forms and shapes. For example, a travelling vane copy distributor may travel along an open side of a stack of collator bins and supply a copy to the bins in accordance with a sequence or a program of instructions. Alternatively, a document distributor may be fixed so that a stack of movable bins will move in front of the distributor for receiving the copies to be collated. In either event, collators of this type have a home position and a preferred direction of collation; i.e., a relative movement between the copy distributor and the collator bins.

SUMMARY OF THE INVENTION

It is an object of the present invention to provide a copy production machine with a collator having a maximal throughput while maintaining high reliability of operation whenever possible.

A copy production machine constructed in accordance with the teachings of the present invention includes a collator having a preferred direction of collation along a first direction, plus a second direction of motion opposite to the first direction for recovering to a home position for collation in the first direction. The copy production machine has means for indicating that copies for more than one image will be simultaneously in the copy production machine in a so-called overlap mode. When the overlap mode is active the copy production machine actuates the collator to collate copies in both of said directions, and in the absence of the overlap mode collate copies only in the first direction, the collator recovering to a home position intermediate successive runs in all runs other than the overlap mode runs.

In a specific form of the invention, a semi-automatic document feed has a preentry sensor which indicates an original document in position to be moved to an imaging position. Whenever such a document is detected at the preentry position while copies are being produced from a different document, an add run indication is provided, placing the machine in an overlap mode such that copies bearing images from a plurality of different image sources, i.e., original documents or electronic sources, require the collator to collate in both directions. In the absence of an original document at the preentry position, collation only occurs in a first direction. Various means for indicating the end of a copy run for determining the overlap mode is included within the present invention. Also, electronic means may contain image-indicating signals and when such image-indicating signals have a predetermined state, the overlap mode is employed. In an automatic document feed any document in a stack of documents for being moved to an imaging position imposes an overlap mode on the copy production machine for requiring bidirectional collation of copies being produced.

The foregoing and other objects, features and advantages of the invention will be apparent from the following more particular description of a preferred embodiment of the invention, as illustrated in the accompanying drawings.

BRIEF DESCRIPTION OF THE DRAWINGS

FIG. 1 is a diagrammatic showing of a machine incorporating the teachings of the present invention.

FIG. 2 is a simplified flow chart showing the operation of the FIG. 1 machine when operating in accordance with the present invention.

FIG. 5 is a simplified diagrammatic showing of indicating a last copy of a copy production run. de

DETAILED DESCRIPTION

Figure 3:
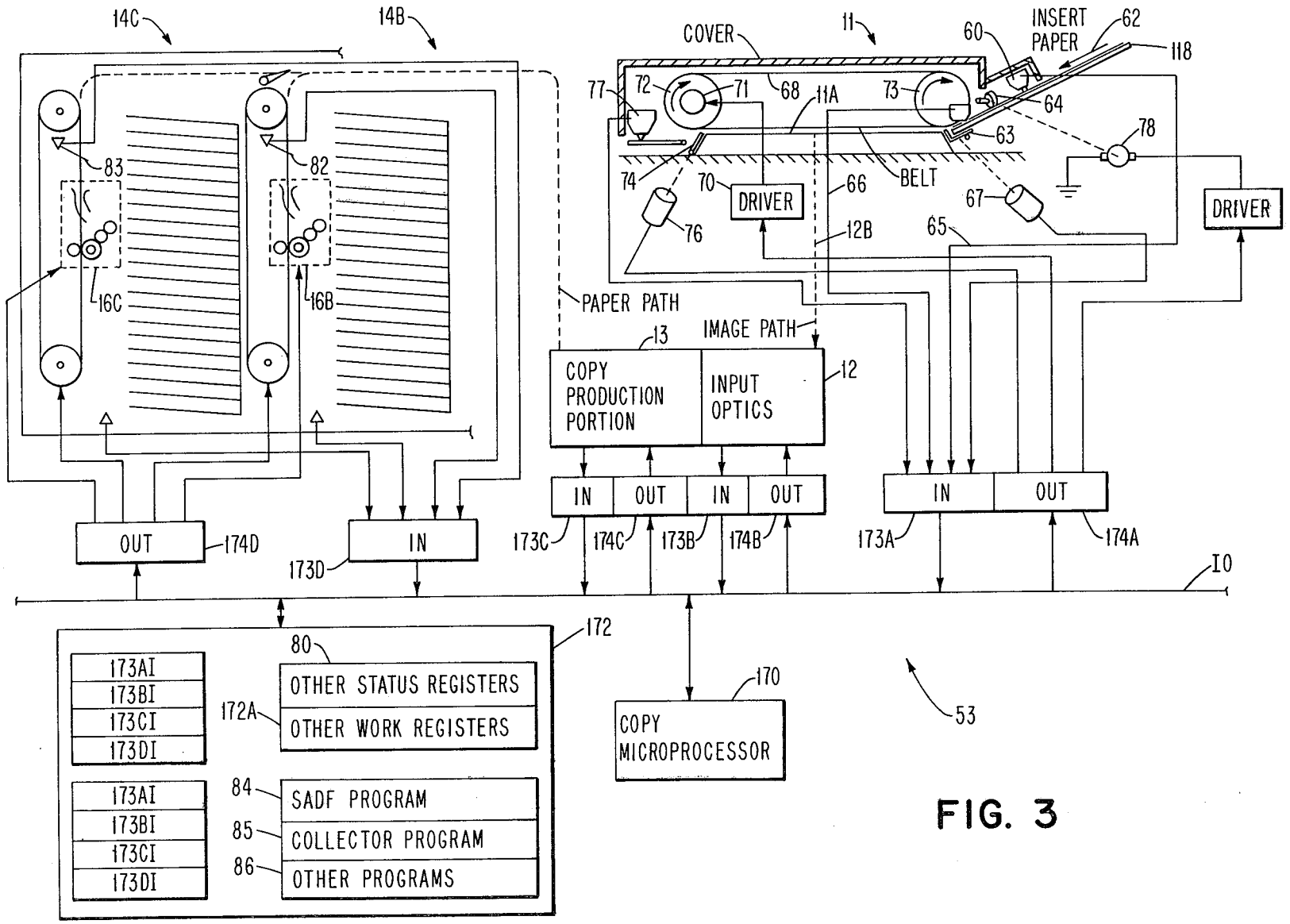
FIG. 3 is a partial simplified diagrammatic showing of the FIG. 1 machine when computer controlled.

Referring now more particularly to the drawings, like numerals indicate like parts and structural features in the various diagrams. An early copy production machine 10 employing the present invention includes a semiautomatic document feed (SADF) 11 for feeding manually inserted original documents to be copied. The document glass 11A (FIGS. 3, 4) in SADF 11 is scanned by known optical scanners in original input optics 12, as indicated by dashed line 12B, to provide an illuminated image over path 23 to a later described copy production portion CPP 13. CPP 13 transfers the line 23 indicated optical image to a copy sheet as will be later described, and supplies the produced copies to output portion 14 for pick up by an operator or for automatic transfer to other utilization apparatus (not shown). In a constructed version of the invention, output portion 14 includes a copy output tray 14A which receives all produced copies in a so-called noncollate mode. When the copy production machine 10 is to be used in an environment requiring automatic collation, a collator 14B is included in output portion 14. When the number of copies to be collated becomes relatively large, a second collator 14C is connected to the first collator 14B in tandem for receiving copies to be collated.

In accordance with the present invention, control means are provided in copy production machine 10 for automatically controlling the mode of operation of collators 14B, 14C in accordance with the status of SADF 11 and particularly in accordance with whether or not CPP 13 is operating in the so-called overlap mode. It is preferred that collators 14B, 14C collate from an upper or home position 15B, 15C, respectively, downwardly to a bottom position at the last collator bins 16B and 16C, respectively. Upon reaching the lowest bin the travelling vane copy distributors 16B, 16C return to the home position. Because of the construction of the collators 14B, 14C, collating from the home positions 15B, 15C toward the respective bottom or remote positions 16B, 16C provides best collation; i.e., most reliable. For jam recovery purposes it is preferred that the collations always occur from top to bottom. The return of the copy distributors 16B and 16C to the home positions 15B, 15C requires time detracting from the throughput of CPP 13. Because of the efficiencies of SADF 11 CPP 13 can operate continuously without missing any image areas as documents are successively supplied to SADF 11 from input tray 11B, as is presently done in the convenience copiers termed Copier II and Copier Series III manufactured by International Business Machines Corporation, Armonk, N.Y. When an original document to be copied is placed on tray 11B such that preentry sensor 60 is activated while copies are being produced by CPP 13, an overlap mode is defined for CPP 13. That is, copies in copy path 17 contain images from more than one original document, i.e., the runs are overlapped within document production machine 10. In this instance, it is desired not to wait for the copy distributors 16B, 16C to return to the home or upper positions 15B, 15C. Accordingly, control 53 responds to sensor 60 during a copy production run to activate collators 14B, 14C to collate in both directions so long as an original document is placed in tray 11B before the end of the current copy production run. At all other times control 53 actuates collators 14B, 14C to return to the home position for unidirectional collation.

FIG. 2 is a simplified flow chart showing the sequence of operations of control 53 for actuating copy production machine 10 as above described. Flow chart represents operations of control 53 either in a programmed computer embodiment shown in FIG. 3 or the harware logic sequence embodiment shown in FIG. 4. It is preferred that the programmed computer embodiment be employed in practicing the present invention. Both embodiments operate the copy production machine 10 in an identical manner.

Referring to FIG. 2, the first step in practicing the invention is determining when there is to be an image change (new original document to be copied) in copy production, as at step 45. In a preferred embodiment an image change or impending image change is indicated by an end of run signal supplied by CPP 13 to control 53. From control 53 the end of run signal is signified as an image change signal on line 46 (FIG. 4) and identified by numeral 46A in FIG. 2.

Figure 4:
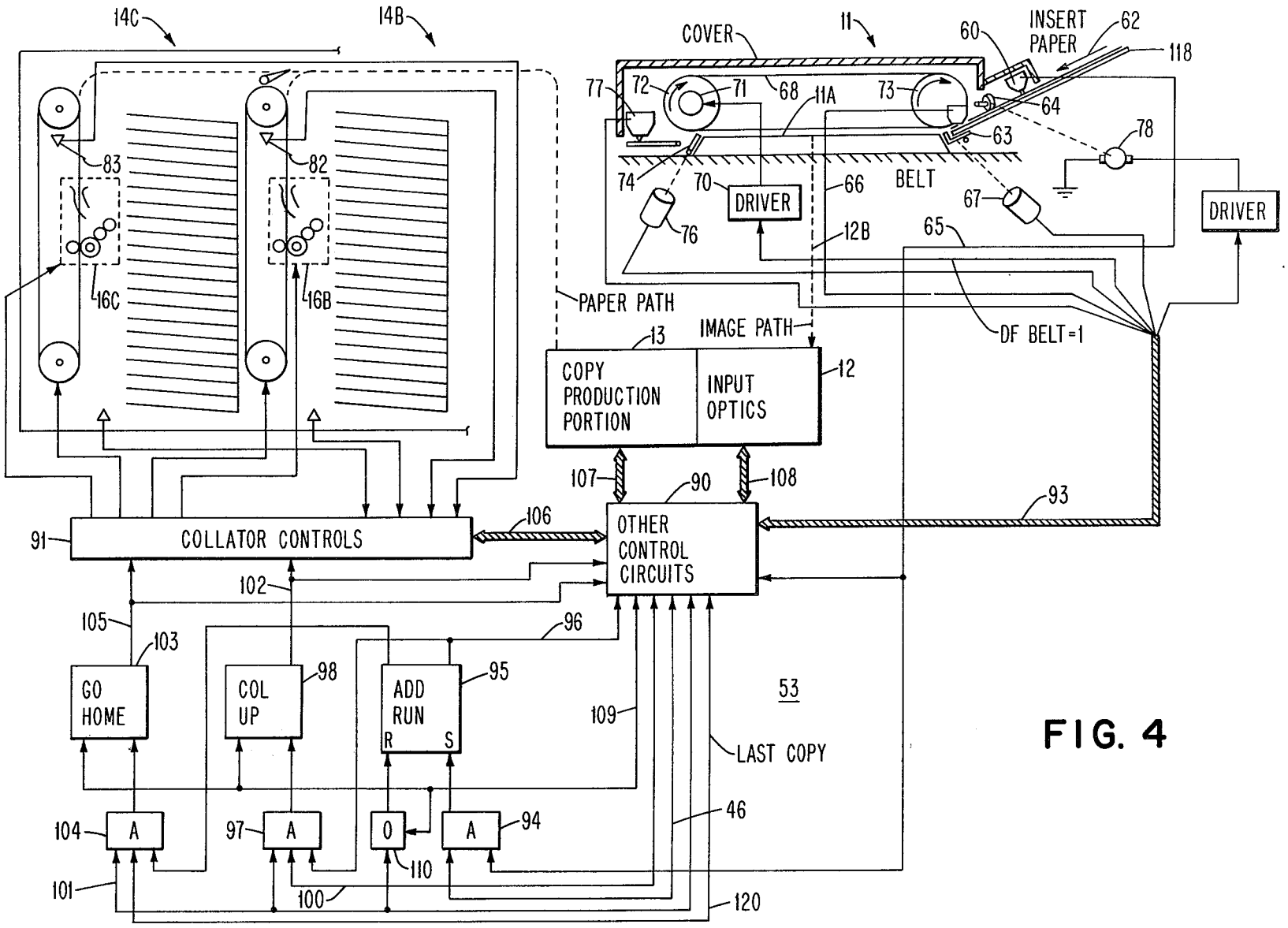
FIG. 4 is a diagrammatic showing similar to FIG. 3 but for hardware logic circuit controls.

Next, the controls 53 must determine the location of collator carriages 16B or 16C. If a single collator 16B is being used, then the vertical location of carriage 16B determines whether or not the appropriate carriage is at home. If so, the collating operation will always proceed from the home position 15B downwardly toward the ultimate position 16L. In the event both collators are used, then the computer must determine the number of images made in each run. If the number of images, i.e., copies, being made is equal to or less than the number of receiving bins in collator 14B then the location of carriage 16B determines whether or not the carriage is "at home." On the other hand, if more than one collator is being used and the number of copies being produced in a run is greater than the bins in collator 14B then the location of carriage 16C in collator 14C is determinative of whether or not the collator is at home. In any event, if the collator is away from the home positions 15B, 15C then the next step in FIG. 2 is to determine whether or not an original document 62 has been inserted in the document receiving tray 11B for adding another run to the collator sequence. This determination is made in step 50 which when zero indicates no original document 62 is in receiving tray 11B. Then the collator carriages 16B, 16C are automatically returned to the home position in the step "collator go home" 51. On the other hand, if there is a document 62 in receiving tray 11B then the next run must be collated up as at step 52. Accordingly, the collator direction of collation is selected in accordance with the location of the collator carriages as well as whether or not a copy producing run is ready to be started in the copy production machine, the latter being signified by a document 62 being sensed by preentry sensor 60 as shown in FIGS. 3 and 4.

Before proceeding further with the detailed description of the invention, the operation of copy production portion (CPP) 13 and SADF 11 are described as a constructed embodiment of a so-called xerographic copy production machine 10, no limitation thereto intended. Photoconductor drum member 20 rotates in the direction of the arrow past a plurality of xerographic processing stations. The first station 21 imposes either a positive or negative electrostatic charge on the surface of photoconductor member 20. It is preferred that this charge be a uniform electrostatic charge over a uniform photoconductor surface. Such charging is done in the absence of light such that projected optical images, indicated by dash line arrow 23, alter the electrostatic charge on the photoconductor member in preparation for image developing and transferring. The projected optical image from original input optics 12 exposes the photoconductor surface in area 22. Light in the projected image electrically discharges the surface areas of photoconductor member 20 in accordance with lightness. With minimal light reflected from the dark or printed areas of an original document, for example, there is no corresponding remains in those areas of the photoconductive surface of member 20 corresponding to the dark of printed areas of an original document in SADF 11 (semiautomatic document feed). This charge pattern is termed a "latent" image on the photoconductor surface. Interimage erase lamp 30E discharges photoconductor member 20 outside defined image areas.

The next xerographic station is developer 24 which receives toner (ink) from toner supply 25 for being deposited and retained on the photoconductive surface still having an electrical charge. The developer station receives the toner with an electrostatic charge of polarity opposite to that of the charged areas of the photoconductive surface. Accordingly, the toner particles adhere electrostatically to the charged areas, but do not adhere to the discharged areas. Hence, the photoconductive surface, after leaving station 24, has a toned image corresponding to the dark and light areas of an original document in SADF 11.

Next, the latent image is transferred to copy paper (not shown) in transfer station 26. The paper is brought to the station 26 from an input paper path portion 27 via synchronizing input gate 28. In station 26, the copy paper (not shown) is brought into contact with the toned image on the photoconductive surface resulting in a transfer of the toner to the copy paper. After such transfer, the sheet of image bearing copy paper is stripped from the photoconductive surface for transport carried image fused thereon in fusing station 31 for creating a permanent image on the copy paper.

Returning now to the photoconductor member 20, after the image area on member 20 leaves transfer station 26, there is a certain amount of residual toner on the photoconductive surface. Accordingly, cleaner station 30 has a rotating cleaning brush (not shown) to remove the residual toner for cleaning the image area in preparation for receiving the next image projected by original input optics 12. The cycle then repeats by charging the just-cleaned image area by charging station 21.

The production of simplex copies or the first side of duplexing copies by portion 13 includes transferring a blank sheet of paper from blank paper supply 35, thence to transfer station 26, fuser 31, and, when in the simplex mode, directly to the output copy portion 14. Blank paper supply 35 has an empty sensing switch (not shown) which inhibits operation of CPP 13 in a known manner whenever supply 35 is out of paper.

When in the duplex mode, duplex diversion gate 42 is actuated by connective 53 to the upward position for deflecting single-image copies to travel to interim storage unit 40 to reside as partially produced duplex copies (image on one side only) waiting for the next subsequent single-image copy producing run in which the copies receive the second image. In the next successive single-image run in the duplex mode, initiated by inserting a document into SADF 11, the copies are removed one at a time from the interim storage unit 40, transported over path 44, thence to input path 27 for receiving a second image, as previously described. The two-image duplex copies are then transferred into output portion 14. Gate 42 is a diagrammatic showing representative of any one of a large plurality of sheet deflecting or directing apparatus usable for the stated purposes.

Preentry switch 60 senses when an original document has been placed in input tray 11B for entry into SADF 11. This condition is defined as "ORGATDF". The condition is signalled to logical control 53 which in turn then actuates SADF 11 to transport the inserted original document onto the document glass 11A. As the original document is being transported onto the document glass 11A, entry sensor 61 senses that the original document is moving onto the document glass 11A. During normal operation trailing edge of the document will be first sensed by sensor 60 indicating the document is no longer at the preentry position. Lastly, it will be sensed by entry sensor 61 as it leaves the entry area and is completely placed on the imaging area of document glass 11A.

CPP 13 also has second or alternate copy paper supply 54 which supplies copy paper to input path 27 via paper path 55. Selection of paper supply 35 or 54 as a copy paper source is controlled from panel 52 by actuation of switches 56. Selection is mutually exclusive. Logical connective 53 responds to switches 56 to actuate paper picker (not shown) in the respective copy paper supplies 35, 54 in a usual manner.

FIGS. 3 and 4 identically illustrate the SADF 11 and its essential connections to logical control 53 for practicing the present invention. The operation will be described with respect to FIG. 3, then the FIG. 4 control will be described. As shown, original document 62 has been placed on input tray 11B, entry gate 63 has not yet been opened, however, entry aligner roll 64 has aligned original document 62 against entry gate 63. Accordingly, both preentry sensor 60 and entry sensor 61 are active (sense original document 62). These conditions are signalled by the two sensors 60, 61 respectively over lines 65 and 66 to input register 173A, bit positions 0 and 1 (not shown). A copy microprocessor 170 periodically scans input register 173A or can be actuated by an interrupt (not described) for sensing that original document 62 is at the illustrated position. In response to sensing the above conditions and assuming that predetermined copy production status of the copy production machine 10 are satisfied, copy microprocessor 170 supplies control signals to output register 174A for opening gate 63. This action is achieved by setting bit position 1 (not shown) of register 174A to the active state. As a result, an activating signal supplied from bit position 1, register 174A to gate solenoid 67 pulls the gate down and allows the original document 62 to be picked up by the SADF transport belt 68. Belt 68 was activated by copy microprocessor 170 at the same time as gate 63 was opened by setting bit position 2 (not shown) of register 174A to the active state for activating driver 70 to actuate SADF motor 71 for moving belt over rollers 72 and 73. As belt 68 engages original document 62, the document moves over the top of document glass 11A against exit gate 74 at the left hand side of document glass 11A. As soon as the document 62 is on the document glass copy production can ensue. Copy microprocessor 170 then actuates CPP 13 and optics 12 in a known manner via output registers 174C and 174B, whereupon input optics 12 scans the document on document glass 11A and causes a transfer of image to copy paper as previously described. Of course, belt 68 is stopped by copy microprocessor 170 deactivating motor 71.

When original document 62 moved onto document glass 11A, preentry sensor 60 first indicated paper left and then entry sensor 61 indicated the document 62 left that position. When both sensors indicate the above sequence, the copy microprocessor 170 reacts to initiate a copy production cycle.

Upon completion of the copy production cycle, exit gate 74 is opened by microprocessor 170 actuating bit position 3 (not shown) of output register 174A to actuate solenoid 76 which frees original document 62 to be exited past exit sensor 77 into an original document exit tray (not shown). When exit sensor 77 senses the leading edge of original document 62 it supplies a signal to input register 173A signifying same. At this time copy microprocessor 170 knows that the original document 62 is being successfully exited to the original document exit tray (not shown). At this time a second original document on input tray 11B may be entered onto document glass 11A. When sensor 77 senses an exit while sensor 61 senses an original document, copy microprocessor 170 should actuate collators 14B, 14C to collate bidirectionally, as will become apparent. The control 53 actuates such bidirectional collator control in response to an end of run signal, later described, occurring when sensor 61 indicates a document is to be entered. Collator control is exercised via output register 174D.

Input aligners 64 are rotated by motor 78 as actuated by bit position 0 (not shown) of output register 174A. These aligners are activated whenever input sensor 60 senses document 62 being inserted on input tray 11B and other copy production prerequisites are met. The rollers 64 are maintained in the active position until entry sensor 61 senses the alignment of original document 62 or a timer (not shown) times out and a document feed error is called.

The arrangement of logical control 53 is that the output registers 174A–D cannot be sensed by copy microprocessor 170. Further, registers 173A–D and 174A–D have the same address except that registers 174A–D are addressed during an output mode of the copy microprocessor 170 while input registers 173A–D are accessed during an input mode. Copy microprocessor 170 must know the signal contents of all output registers 174A–D at all times. Accordingly, it provides an image of the signal content of all output registers 174A–D in main memory 172 at all times. One of the registers within main memory 172 is designated to contain a signal image for one of the respective output registers; that is, numeral 174AI indicates the memory register for the image of the signal content of output register 174A, etc. through 174DI. In this manner, copy microprocessor, by reading register 174AI, can immediately determine the control status being supplied to the SADF 11. Control signals to other portions of the copy production machine 10 from other output registers 174B–D are sensed in memory register 174B–D, respectively. For convenience, the input registers 173A–D are also imaged in memory 172 in registers 173AI–DI. Additionally, certain work registers 172A are assigned to work within memory 172 for the convenience of copy microprocessor 170. Also, other status registers 80 have signal contents useful in operating copy microprocessor 170 in implementing the invention.

In setting up copy production machine 10 to operate, copy microprocessor 170 in response to the end of run signal, as later described, received from copy production portion 13 via input register 173C when a new document 62 is being sensed by sensor 61 actuates collators 14B, 14C to bidirectionally collate by sending appropriate control signals over bidirectional bus I/O to output register 174D. The status of the collator copy distributors 16B and 16C are respectively indicated by home sensors 82, 83. When copy distributors or travelling vanes 16B, 16C are in the home position, sensors 82, 83 supply appropriate signals to copy microprocessor 170 via input register 173D. Additionally, copy microprocessor 170 in other status registers 80 keeps an indication of the physical location of copy distributors 16B, 16C. On comparing the sensor outputs 82, 83 with the stored status in registers 80 copy microprocessor 170 executes steps 47 and 50 as previously described and as shown in the code included in Tables I and II. The microcode in Table I represents the control of SADF 11, while the microcode in Table II represents the control of collators 14B and 14C in accordance with the illustration of FIG. 2. Such programs are resident in main memory 172 as a SADF program at 84, collator program at 85. It is understood, of course, that copy microprocessor 170 in controlling copy production machine 10 includes a multitude of programs collectively denoted as other programs 86. It is to be further understood that the SADF program 84 and the collator program 85 include portions illustrated in Tables I and II which may be physically and logically with other programs for programming ease and copy microprocessor 170 efficiencies, as is well known in the programming arts. It is also to be understood that the total program control of SADF 11 and collators 14B, 14C in conjunction with CPP 13 and input optics 12 will include instructions not shown in Tables I or II which are not necessary to an understanding of the current invention, but are convenient for control of copy production machine 10.

TABLE I - SADF PROGRAM

```
LOC  OBJ     OP1  OP2        SOURCE  STATEMENT

                                 1. IF NOT CEMODE (SADF EXERCISE)
5D1A A662    0062                    LB        CEMODE
5D1C A808    0008                    CI        CESADF
5D1E 62      5D22                    JNE       SADF23A
5D1F 308F5E  5E8F 0000               BU        SADF03,R0
                                 1. THEN
             5D22            SADF23A DC        *
                                 2. . IF  ¬INHFD1 (¬MANUAL OPERATION)
                                      TPB       PSB31,INHFD1
5D22 A65F    005F
5D24 95      0005
5D25 49      5D29                    JZ        SADF23B
5D26 308F5E  5E8F 0000               BU        SADF03,R0
                                 2. . THEN
             5D29            SADF23B DC        *
                                 3. . . IF  ¬LFTCRDOC &LIDDWNSW
                                      TPB       PCB05,LFTCRDOC
5D29 A676    0076
5D2B 97      0007
5D2C 34BF    5E8F                    BNZ       SADF03
                                     RIN       CSB09
5D2E A6D0    00D0
5D30 95      0005                    TP        LIDDWN
5D31 358F    5E8F                    BZ        SADF03
                                 3. . . THEN
                                 4. . . . PROCESS  SADFENTR TO ENTER A DOCUMENT ONTO GLASS
```

```
LOC  OBJ     OP1  OP2        SOURCE  STATEMENT

5D1A A662    0062                 LB        CEMODE
5D1C A808    0008                 CI        CESADF
5D1E 62      5D22                 JNE       SADF23A
5D1F 308F5E  5E8F 0000            BU        SADF03,R0
                            1. THEN
             5D22        SADF23A  DC        *
                            2. . IF  ¬INHFD1 (¬MANUAL OPERATION)
                                 TPB       PSB31,INHFD1
5D22 A65F    005F
5D24 95      0005
5D25 49      5D29                 JZ        SADF23B
5D26 308F5E  5E8F 0000            BU        SADF03,R0
                            2. . THEN
             5D29        SADF23B  DC        *
                            3. . . IF  ¬LFTCRDOC &LIDDWNSW
                                 TPR       PCB05,LFTCRDOC
5D29 A676    0076
5D2B 97      0007
5D2C 34BF    5E8F                 BNZ       SADF03
                                  RIN       CSB09
5D2E A6D0    00D0
5D30 95      0005                 TP        LIDDWN
5D31 35BF    5E8F                 BZ        SADF03
                            3. . . THEN
                            4. . . . PROCESS  SADFENTR TO ENTER A DOCUMENT ONTO GLASS
                                 INCLUDE SADFENTR

                                 ISEG SADFENTR
                             BEGIN  SADFENTR
             5D33        SADFENTR DC
                            1. TEXT
                          THIS SEGMENT MONITORS PRE-ENTRY,STARTS ENTRY,SETS SADFBUSY
                            1. ENDTEXT
                            1. IF  ORGATDF
                                 RIN       CSB09
5D33 A6D0    00D0
5D35 94      0004                 TP        ORGATDF
5D36 3DC6    5DC6                 BZ        SADF30
                            1. THEN
                            2. . SET CLUTCH TIMER=255
5D38 AEFF    00FF                 LI        255
5D3A A15B    005B                 STB       CLUTCHTR
                            2. . IF  RELAY2=0
5D3C A9A0    00A0                 GI        INTOFF
5D3E A67C    007C                 LB        PCB12
5D40 AF40    0006                 TS        RELAY2
5D42 69      5D49                 JNZ       ENTER1
                            2. . THEN
                            3. . . TURN RELAY 2 ON
5DBF 64      5DC4                 JNZ       SADF29
                            4. . . . THEN
                            5. . . . . SET ALIGNTMR=3
5DC0 AE03    0003                 LI        3
5DC2 A14B    004B                 STB       ALIGNTMR

                            4. . . . ENDIF
                            3. . . ENDIF
                            2. . . . ENDIF
             5DC4        SADF29   DC        *
5DC4 2CF6    5DF6                 B         SADF31
                            1. ELSE
             5DC6        SADF30   DC        *
                            2. . IF  ¬DFENTRY
5DC6 A679    0079                 LB        PCB09
5DC8 95      0005                 TP        DFENTRY
5DC9 3CE0    5DE0                 BNZ       SADF30A
                            2. . THEN
                            3. . . IF  DFCLUTCH=0 (ALIGNER ON)
5DCB A9A0    00A0                 GI        INTOFF
5DCD A679    0079                 LB        PCB09
5DCF AF04    0002                 TS        DFCLUTCH
5DD1 3CF6    5DF6                 BNZ       SADF31
                            2. . ELSE
                            3. . . IF  ORGINDF &ALIGNTMR ¬=0
                                 RIN       CSB09
5DE0 A6D0    00D0
5DE2 93      0003                 TP        ORGINDF
5DE3 3DF6    5DF6                 BZ        SADF31
5DE5 A64B    004B                 LB        ALIGNTMR
5DE7 A800    0000                 CI        0
5DE9 46      5DF6                 JE        SADF31
                            3. . . THEN
                            4. . . . DECREMENT ALIGNTMR
5DEA 2A                           S1
```

```
LOC  OJB    OP1  OP2        SOURCE  STATEMENT

5DEB A14B   004B                 STB       ALIGNTMR
                              4. . . . IF  ALIGNTMR=0
5DED A800   0000                 CI        0
5DEF 66     5DF6                 JNE       SADF31
                              4. . . . THEN
                              5. . . . . SET ENTERING
                                 TSB       PSB31,ENTERING
5DF0 A65F   005F
5DF2 AF01   0000
5DF4 A15F   005F
                              4. . . . ENDIF
                              3. . . ENDIF
                              2. . ENDIF
                              1. ENDIF
            5DF6        SADF31   DC        *
5DF6 A920   0020                 GI        INTON
                               ENDBEGIN  SADFENTR
                                 IEND SADFENTR
                              4. . . . IF  SADFBUSY
                                 TPB       PSB31,SADFBBUSY
5E1A A65F   005F
5E1C 93     0003
5E1D 3D8F   5E8F                 BZ        SADF03
                              4. . . . THEN
                              5. . . . . IF  ¬ORGINDF &DFBELT=1 &¬DFEXIT
                                 RIN       CSB09
5E1F A6D0   00D0
5E21 93     0003                 TP        ORGINDF
5E22 3C8B   5E8B                 BNZ       SADF02
5E24 A679   0079                 LB        PCB09
5E26 96     0006                 TP        DFBELT

5E27 3D8B   5E8B                 BZ        SADF02
5E29 94     0004                 TP        DFEXIT
5E2A 3C8B   5E8B                 BNZ       SADF02
                              5. . . . . THEN
                              6. . . . . . DECREMENT TET
5E2C A64C   004C                 LB        TET
5E2E 2A                          S1
5E2F A14C   004C                 STB       TET
                              6. . . . . . IF  TET< = 0
5E31 A800   0000                 CI        0
5E33 3E8F   5E8F                 BH        SADF03
                              6. . . . . . THEN
                              7. . . . . . . IF  ENTERING=1
                                 TPB       PSB31,ENTERING
5E35 A65F   005F
5E37 90     0000
5E38 3D87   5E87                 BZ        SADF01A
                              7. . . . . . . THEN
                              8. . . . . . . . DFENTRY=0
5E3A A9AD   00A0                 GI        INTOFF
                                 TRB       PCB09,DFENTRY
5E3C A679   0079
5E3E B5     0005
5E3F A179   0079
5E41 A920   0020                 GI        INTON
                              8. . . . . . . . IF  SADFTMR<KI &¬INDF &¬SADFEXIT
                                 LID       350
5E43 AE01   015E
5E45 29
5E46 AE5E   015E
5E48 CA     000A                 SR        SADFTMR

                                 BL        SADF01
5E49 3F4D   5E4D
5E4B 2C62   5E62
5E4D A65F   005F                 LB        PSB31
                                 TSM       P(INDF,SADFEXIT)
5E4F AF42   0042
5E51 62     5E62                 JNZ       SADF01
                              8. . . . . . . THEN
                              9. . . . . . . . STARTDF=1
5E52 A9A0   00A0                 GI        INTOFF
                                 TSB       PSB22,STARTDF
5E54 A656   0056
5E56 AF08   0003
5E58 A156   0056
                              9. . . . . . . . INDF=1
                                 TSB       PSB31,INDF
5E5A A65F   005F
5E5C AF40   0006
5E5E A15F   005F
```

```
LOC  OBJ    OP1  OP2        SOURCE STATEMENT

5E60 A920   0020                GI        INTON
                             8. . . . . . . . ENDIF
            5E62         SADF01  DC
                             8. . . . . . . . IF  SADFTMR≤K2
                                LID       320
5E62 AE01   0140
5E64 29
5E65 AE40   0140
5E67 CA     000A                SR        SADFTMR
                                BL        SADF04
5E68 3F6C   5E6C
5E6A 2C9B   5E9B

                             8. . . . . . . . THEN
                             9. . . . . . . . . DFBELT=0
                             9. . . . . . . . . SADFTMR=0
5E6C A9A0   00A0                GI        INTOFF
                                TRB       PCB09,DFBELT
5E6E A679   0079
5E70 B6     0006
5E71 A179   0079
5E73 A920   0020                GI        INTON
5E75 25                         CLA
5E76 8A     000A                STR       SADFTMR
                             9. . . . . . . . . IF  ¬ORGATDF
                                RIN       CSB09
5E77 A6D0   00D0
5E79 94     0004                TP        ORGATDF
5E7A 3C8F   5E8F                BNZ       SADF03
                             9. . . . . . . . . THEN
                            10. . . . . . . . . . DFCLUTCH=1
5E7C A9A0   00A0                GI        INTOFF
                                TSB       PCB09,DFCLUTCH
5E7E A679   0079
5E80 AF04   0002
5E82 A179   0079
5E84 A920   0020                GI        INTON
5E86 0F     5E8F                J         SADF03
                             9. . . . . . . . . ENDIF
                             8. . . . . . . . ENDIF
            5E87         SADF01A  DC        *
                             7. . . . . . . ELSE
                             8. . . . . . . . SADFTMR=1
5E87 25                         CLA

5E88 AE01   0001                LI        1
5E8A 8A     000A                STR       SADFTMR
                             7. . . . . . . ENDIF
                             6. . . . . . ENDIF
                             5. . . . . ELSE
            5E8B         SADF02  DC
                             6. . . . . . TET=12
5E8B AE0C   000C                LI        12
5E8D A14C   004C                STB       TET
                             5. . . . . ENDIF
                             4. . . . ENDIF
                             3. . . ENDIF
                             2. . ENDIF
                             1. ENDIF
            5E8F         SADF03  DC
                             1. IF  SADFEXIT=1
5E8F A65F   005F                LB        PSB31
```

TABLE II - COLLATOR CONTROLS

```
LOC  OBJ    OP1  OP2      SOURCE STATEMENT

                          -- NONPERTINENT CODE--

                          2. . IF  COLLATE LIGHT &(¬SIDE-2 |SIDE2REV) & (ACR2 @ACR3 WENT TO
                                   0)
                             TPB       PCB06,COL
467F A677   0077
4681 91     0001
4682 3DA5   A6A5             BZ        ACD01
                             TPB       PSB20,DPXSIDE2
4684 A654   0054
4686 95     0005
4687 4D     468D             JZ        ACDO10                "END OF A
                             TPB       PSB43,SIDE2REF         COPY RUN
4688 66B    006B                                             AND
468A 95     0005                                             OVERLAP
468B 3DA5   46A5             BZ        ACD01                  MODE"
                             TPB       PSB43,ACRBILL2
```

```
LOC  OBJ    OP1  OP2        SOURCE STATEMENT

468D A66B   006B
468F 94     0004
4690 45     4695                JZ        ACD02
4691 25                         CLA
4692 DE     000E                AR        ACRREG
4693 3DA5   46A5                BZ        ACD01
                            2. . THEN
                                EQU       *
                            3. . . SET REVVANE  --  To reverse collate direction.
                                SRG       COLRG
4695 A9D0   00D0

                                TSB       CPSB07,REVVANE
4697 A618   0018
4699 AF02   0001
469B A118   0018
                            3. . . TOGGLE COLDOWN  --  Reverses collate direction.

469D A617   0017                LB        CPSB06
469F AD80   0080                XI        P1(COLDOWN)
            -- THE ABOVE CODE ACTS AS A TOGGLE SWITCH TO REVERSE
               COLLATION DIRECTION IN THE COLLATE MODE --

                            -- NONPERTINENT CODE --

46A1 A117   0017                STB       CPSB06
                                SRG       INTHRG
46A3 A9C8   00C8
                            2. . ENDIF
            46A5                DC        *
                            2. . IF  ACR1 WENT TO 0  --  Last Copy
46A5 25                         CLA                    End of
46A6 A40E   000E                AB        ACRREGLO     Job Go
46AB 3CFE   46FE                BNZ       ACRL14       Home
                            2. . THEN
                            3. . . TURN TRUCKS OFF
                                TRMB      PCB02,P(PRMTRCK,ALTTRUCK,DPLXTRCK)
46AA A673   0073
46AC ABE3   00E3
46AE A173   0073

                            -- NONPERTINENT CODE --

                            3. . . IF  END
46B6 A643   0043                TPB       PSB03,END
46B8 97     0007
46B9 3DFE   46FE                BZ        ACRL14
                            3. . . THEN
                            4. . . . SET HOMCOL1R,HOMCOL2R,COLDOWN
                                SRG       COLRG
46BB A9D0   00D0
                                TSMB      CPSB07,P(HOMCOL1R,HOMCOL2R)
46BD A618   0018
46BF AF90   0090
46C1 A118   0018
                                TSB       CPSB06,COLDOWN
46C3 A617   0017
46C5 AFB0   0007
46C7 A117   0017

                            -- NONPERTINENT CODE --

                            3. . . IF  (COLVANE1)
69C4 B6     0006                TR        COLVANE1  TEST FOR COL VANE1
69C5 4A     69CA                JZ        COLV100   *GO IF NOT SET
                            3. . . THEN
                            4. . . . COLVANE1=0
69C6 A117   0017                STB       CPSB06    UPDATE
69C8 247B   6A7B                B         COLV210
                            3. . . ELSE
            69CA        COLV100 DC        *
                            4. . . . IF  (COLVANE2)
69CA B5     0005                TR        COLVANE2  TEST FOR COL VANE2

                            4. . . . THEN
                            5. . . . . COLVANE2=0
69CD A117   0017                STB       CPSB06    UPDATE
                            5. . . . . IF  (COLDOWN)
                                TPB       CPSB06,COLDOWN  --  Sense collate direction.
69CF A617   0017
69D1 97     0007
69D2 353D   6A3D                BZ        COLV140   *GO IF NOT SET
                            5. . . . . THEN
                            6. . . . . . IF  (¬CEVNEHLD)
                                TPB       CPSB05,CEVNEHLD.
```

```
LOC  OBJ     OP1  OP2        SOURCE STATEMENT
69D4 A616    0016
69D6 96      0006
69D7 63      69E3                JNZ       COLV105
                              6. . . . . . THEN
                              7. . . . . . . INCR VANECTR  --  Vane counter.
69D8 F4      0004                LRB       VANECTR
69D9 AB0F    000F                NI        X'OF'
69DB AB0A    000A                CI        X'OR'

                              -- NONPERTINENT CODE --

                                     COLLATOR VANE CONTROL  --  (16B, 16C Controls)
                              1. ENDTEXT
                              1. IF  (CEVNEHLD)  --  CE mode check.
6A7B A990    0090                GI        INTOFFCG+COLRG
                                 TPB       CPSB05,CEVNEHLD
6A7D A616    0016
6A7F 96      0006
6A80 49      6A89                JZ        COLVC05

                              1. THEN
                              2. . RESET HOMCOL1R,HOMCOL2R,MD1UPR,MD2UPR,MD1DOWNR,MD2DOWNR
                           TRMB CPSB07,P(HOMCOL1R,HOMCOL2R,MD1UPR,MD2UPR,MD1DOWNR,MD2DOWNR)
6A81 A618    0018
6A83 AB03    0003
6A85 A118    0018
6A87 2466    6B66                B         COLVC200
                              1. ELSE
             6A89         COLVC05 DC        *
6A89 A909    0009                GI        INTONCG+BASERG
                              2. . IF  (COLMOTOR)
                                 TPB       PCB15,COLMOTOR
6A8B A67F    007F
6A8D 95      0005
6A8E 3566    6B66                BZ        COLVC200
                              2. . THEN
                              3. . . IF  (MD2PRESS)
                                 RIN       CSB14     GET STATUS
6A90 A6D5    00D5
6A92 96      0006                TP        MD2PRES  --  Module 2 (14C) present.
6A93 3DF5    6AF5                BZ        COLVC100
                              3. . . THEN
                              4. . . . IF (COL2HOM)
6A95 94      0004                TP        COL2HOM  --  Collator 2 vane 16C home.
6A96 3DB46AB4                    BZ        COLVC10
                              4. . . . THEN
                              5. . . . . OUTPUT MD2VANUP=0  --  Vane ready to go down.
6A98 A9A0    00A0                GI        INTOFF    MASK
                                 TRB       PCB14,MD2VANUP
6A9A A67E    007E
6A9C B5      0005

6A9D A17E    007E
6A9F A910    0010                GI        INTONCG+COLRG
                              5. . . . . RESET MD2UPR
6AA1 A618    0018                LB        CPSB07    GET STATUS
6AA3 B3      0003                TR        MD2UPR
                              5. . . . . IF  (HOMCOL2R)
6AA4 B4      0004                TR        HOMCOL2R
6AA5 3DBC    6ABC                BZ        COLVC20
                              5. . . . . THEN
                              6. . . . . . RESET HOMCOL2R,MD2DOWNR  --  16C to 60 down next.
6AA7 B2      0002                TR        MD2DOWNR
6AA8 29                          TRA
                              6. . . . . . OUTPUT MD2VANDW=0
6AA9 A989    0089                GI        INTOFFCG+BASERG
                                 TRB       PCB14,MD2VANDW
6AAB A67E    007E
6AAD B4      0004
6AAE A17E    007E
6AB0 A910    0010                GI        INTONCG+COLRG
6AB2 29                          TRA
6AB3 0C      6ABC                J         CULVC20
                              5. . . . . ENDIF
                              4. . . . ELSE
             6AB4         COLVC10 DC        *
                              5. . . . . (IF  (HOMCOL2R)
                                 SRG       COLRG
6AB4 A9D0    00D0
6AB6 A618    0018                LB        CPSB07    GET STATUS
6AB8 94      0004                TP        HOMCOL2R  TEST STATE OF HOMCOL2R
6AB9 4C      6ABC                JZ        COLVC20   *GO IF NOT SET
```

```
LOB  OBJ     OP1  OP2      SOURCE STATEMENT

                              5. . . . . THEN
                              6. . . . . . SET MD2UPR  --  16C to go up.
6ABA AF08    0003                TS        MD2UPR
                              5. . . . . ENDIF
                              4. . . . ENDIF
             6ABC        COLVC20  DC        *
6ABC A118    0018                STB       CPSB07    UPDATE
                              4. . . . IF  (MD2DOWNR)
6ABE 92      0002                TP        MD2DOWNR
6ABF 47      6AC7                JZ        COLVC30   *GO IF NOT SET
                              4. . . . THEN
                              5. . . . . OUTPUT MD2VANDW=1
6AC0 A989    0089                GI        INTOFFCG+BASERG
6AC2 A67E    007E                LB        PCB14     GET STATUS
6AC4 AF10    0004                TS        MD2VANDW
6AC6 0F      6ACF                J         COLVC40
                              4. . . . ELSE
             6AC7        COLVC30  DC        *
                              5. . . . . IF  (MD2UPR)
6AC7 93      0003                TP        MD2UPR
6AC8 A989    0089                GI        INTOFFCG+BASREG
6ACA 41      6AD1                JZ        COLVC50   *GO NOT SET
                              5. . . . . THEN
                              6. . . . . . OUTPUT  MD2VANUP=1
6ACB A67E    007E                LB        PCB14
6ACD AF20    0005                TS        MD2VANUP
                              5. . . . . ENDIF
                              4. . . . ENDIF
6ACF A17E    007E        COLVC40  STB       PCB14
             6AD1        COLVC50  DC        *

                              4. . . . IF  (COL2INDX)
                                  RIN       CSB14     GET STATUS
6AD1 A6D5    00D5
6AD3 93      0003                TP        CL2INDX  -- Collator 2 index.
6AD4 A910    0010                GI        INTONCG+COLRG
6AD6 A618    0018                LB        CPSB07
6AD8 3DEA    6AEA                BZ        COLVC80   *GO IF CL2INDX NOT SET
                              4. . . . THEN
                              5. . . . IF  (MD2DOWNR)
6ADA B2      0002                TR        MD2DOWNR
6ADB 46      6AE6                JZ        COLVC60   *GO IF NOT SET
                              5. . . . . THEN
                              6. . . . . . RESET MD2DOWNR
6ADC A118    0018                STB       CPSB07    UPDATE
                              6. . . . . . OUTPUT MD2VANDW=0  --  Vane to go up.
6ADE A989    0089                GI        INTOFFCG+BASERG
                                 TRB       PCB14,MD2VANDW
6AE0 A67E    007E
6AE2 B4      0004
6AE3 A17E    007E
6AE5 09      6AE9                J         COLVC70
                              5. . . . . ELSE
             6AE6        COLVC60  DC        *
                              6. . . . . . RESET MD2UPR
6AE6 B3      0003                TR        MD2UPR
6AE7 A118    0018                STB       CPSB07    UPDATE
                              5. . . . . ENDIF
6AE9 04      6AF4        COLVC70  J         COLVC90
                              4. . . . ELSE
             6AEA        COLVC80  DC        *

                              5. . . . . IF  (¬MD2UPR &MD2VANUP)
6AEA 93      0003                TP        MD2UPR
6AEB 64      6AF4                JNZ       COLVC90   *GO IF ALREADY SET
6AEC A989    0089                GI        INTOFFCG+BASERG
6AEE A67E    007E                LB        PCB14     GET STATUS
6AF0 B5      0005                TR        MD2VANUP
6AF1 44      6AF4                JZ        COLVC90
                              5. . . . . THEN
                              6. . . . . . OUTPUT MD2VANUP=0
6AF2 A17E    007E                STB       PCB14     UPDATE
                              5. . . . . ENDIF
                              4. . . . ENDIF
6AF4 0D      6AFD        COLVC90  J         COLVC110
                              3. . . ELSE
             6AF5        COLVC100 DC        *
                              4. . . . RESET HOMCOL2R,MD2UPR,MD2DOWNR
                                 SRG       COLRG
6AF5 A9D0    00D0
                                 TRMB      CPSB07,P(HOMCOL2R,MD2UPR,MD2DOWNR)
6AF7 A618    0018
6AF9 ABE3    00E3
6AFB A118    0018
```

```
LOC  OBJ     OP1  OP2     SOURCE STATEMENT
                              3. . . ENDIF
             6AFD       COLVC110 DC        *
                              3. . . IF  (COL1HOM)  --  Is collator 1, 16B home.
                                  SRG       BASERG
6AFD A9C9    00C9
                                  RIN       CSB06     GET STATUS
6AFF A6C5    00C5
6B01 96      0006                 TP        COL1HOM
6B02 3D26    6B26                 BZ        COLVC120  *GO IF COL1HOM NOT SET

                              3. . . THEN
                              4. . . . OUTPUT  VANEUP=0
6B04 A9A0    00A0                 GI        INTOFF
                                  TRB       PCB06,VANEUP
6B06 A677    0077
6B08 B5      0005
6B09 A177    0077
6B0B A910    0010                 GI        INTONCG+COLRG
                              4. . . . RESET MD1UPR
6B0D A618    0018                 LB        CPSB07
6B0F B6      0006                 TR        MD1UPR
                              4. . . . IF  (HOMCOL1R)
6B10 B7      0007                 TR        HOMCOL1R
6B11 3D2E    6B2E                 BZ        COLVC130
                              4. . . . THEN
                              5. . . . . RESET HOMCOL1R,MD1DOWNR
6B13 B5      0005                 TR        MD1DOWNR
6B14 29                           TRA
                              5. . . . . SET COLDOWN  --  Collate down.
                                  TSB       CPSB06,COLDOWN
6B15 A617    0017
6B17 AF80    0007
6B19 A117    0017
                              5. . . . . OUTPUT  VANEDWN=0
6B1B A989    0089                 GI        INTOFFCG+BASERG
                                  TRB       PCB06,VANEDWN
6B1D A677    0077
6B1F B6      0006
6B20 A177    0077
6B22 A910    0010                 GI        INTONCG+COLRG
6B24 29                           TRA

6B25 0E      6B2E                 J         COLVC130
                              4. . . . ENDIF
                              3. . . ELSE
             6B26       COLVC120 DC        *
                              4. . . . IF   (HOMCOL1R)
                                  SRG       COLRG
6B26 A9D0    00D0
6B28 A618    0018                 LB        CPSB07
6B2A 97      0007                 TP        HOMCOL1R
6B2B 4E      6B2E                 JZ        COLVC130  *GO IF NOT SET
                              4. . . . THEN
                              5. . . . . SET MD1UPR
6B2C AF40    0006                 TS        MD1UPR
                              4. . . . ENDIF
                              3. . . ENDIF
             6B2E             COLVC130      DC        *
6B2E A118    0018                 STB       CPSB07
                              3. . . IF  (MD1DOWNR)
6B30 95      0005                 TP        MD1DOWNR
6B31 49      6B39                 JZ        COLVC140  *GO IF NOT SET
                              3. . . THEN
                              4. . . . OUTPUT VANEDWN
6B32 A989    0089                 GI        INTOFFCG+BASERG
6B34 A677    0077                 LB        PCB06     GET STATUS
6B36 AF40    0006                 TS        VANEDWN
6B38 01      6B41                 J         COLVC150
                              3. . . ELSE
             6B39       COLVC140 DC        *
                              4. . . . IF  (MD1UPR)
6B39 96      0006                 TP        MD1UPR
6B3A 43      6B43                 JZ        COLVC160

                              4. . . . THEN
                              5. . . . . OUTPUT VANEUP=1  -- Go up.
6B3B A989    0089                 GI        INTOFFCG+BASERG
6B3D A677    0077                 LB        PCB06
6B3F AF20    0005                 TS        VANEUP
```

```
LOB  OBJ    OP1  OP2     SOURCE STATEMENT
                              4. . . . ENDIF
                              3. . . ENDIF
6B41 A177   0077       COLVC150 STB       PCB06     UPDATE
            6B43       COLVC160 DC        *
                              3. . . IF  (COL1INDX)
                                  RIN       CSB06     GET STATUS
6B43 A6C5   00C5
6B45 97     0007                  TP        CL1INDX
6B46 A910   0010                  GI        INTONCG+COLRG
6B48 A618   0018                  LB        CPSB07
6B4A 3D5C   6B5C                  BZ        COLVC190  *GO IF CL1INDX NOT SET  --  Collate 1 index.
                              3. . . THEN
                              4. . . . IF  (MD1DOWNR)
6B4C B5     0005                  TR        MD1DOWNR
6B4D 48     6B58                  JZ        COLVC170  *GO IF NOT SET
                              4. . . . THEN
                              5. . . . . RESET MD1DOWNR
6B4E A118   0018                  STB       CPSB07    UPDATE
                              5. . . . . OUTPUT  VANEDWN=0
6B50 A989   0089                  GI        INTOFFCG+BASERG
                                  TRB       PCB06,VANEDWN
6B52 A677   0077
6B54 B6     0006
6B55 A177   0077
6B57 0B     6B5B                  J         COLVC180

                              4. . . . ELSE
            6B58       COLVC170 DC        *
                              5. . . . . RESET MD1UPR
6B58 B6     0006                  TR        MD1UPR
6B59 A118   0018                  STB       CPSB07    UPDATE
                              4. . . . ENDIF
6B5B 06     6B66       COLVC180 J         COLVC200
                              3. . . ELSE
            6B5C       COLVC190 DC        *
                              4. . . . IF  (¬MD1UPR &VANEUP)
6B5C 96     0096                  TP        MD1UPR
6B5D 66     6B66                  JNZ       COLVC200
6B5E A989   0089                  GI        INTOFFCG+BASERG
6B60 A677   0077                  LB        PCB06     GET STATUS
6B62 B5     0005                  TR        VANEUP
6B63 46     6B66                  JZ        COLVC200  *GO ALREADY 0
                              4. . . . THEN
                              5. . . . . OUTPUT  VANEUP=0
6B64 A177   0077                  STB       PCB06     UPDATE
                              4. . . . ENDIF
                              3. . . ENDIF
                              2. . ENDIF
                              1. ENDIF
            6B66       COLVC200 DC        *
                              ENDBEGIN COLVCNTL
                                  IEND COLVCNTL
```

FIG. 4 diagrammatically illustrates a second embodiment consisting of hardware logic circuits for performing the same functions as described above and as executed in the microcode program executed by copy microprocessor 170 insofar as practicing the present invention is concerned. Therefore it can be said that this logic representation fairly represents the computer program in a limited sense for better understanding the practice of the present invention. Other control circuits 90 represent those computer programs in copy microprocessor 170 not pertinent to the present invention, as well as those known relay control circuits and logic control circuits as used in prior art in copy production machines such as the Copier II and Copier Series III produced by International Business Machines Corporation, Armonk, N.Y. Additionally, the collator controls 91 for controlling the collators 14B, 14C are those controls shown in the LeClere application, supra. Other control circuits 90 additionally provide a communication path (not shown) between SADF 11 circuits, CPP 13, input optics 12, collator controls 91, and the additional circuits later described for implementing the present invention.

The connections to SADF 11 are combined into cable 93 and broken out as shown at the top of the figure in the same sense that the connections of input register 173 and output register 174A are made. The lines in the SADF 11 area generally represented by numerals 60–78 are identical to that described for FIG. 3. In any event, at the end of a run copy production portion 13 supplies a suitable end of run signal during collate mode, later described, to other control circuits 90. Other control circuits 90 then supply an image change signal (only during collate mode) over line 46 to AND circuit detector 94. AND circuit detector 94 compares the image change signal from line 46 with the output status of sensor 60 signal supplied over line 65 to set add run latch 95 to the active condition simplifying overlap mode will occur. When the add run latch 95 is set to the active condition bidirectional collation should occur. A variation is present in this embodiment in that rather than using preentry sensor 61 as determining bidirectional collation sensor 60 is used. In any event, add run latch 95 being set supplies a suitable control signal over line 96 to other control circuits 90 indicating bidirectional collation. Additionally, the line 96 add run signal partially enables AND circuit 97 to determine whether or not the collators 14B, 14C should collate in the up direction as by setting latch 98. In this regard, sensors 82, 83 supply the home signal condition through collator controls 91 to other control circuits 90. If both vane copy distributors 16B, 16C are in the home position, AND circuit 97 is inhibited. On the other hand, if the copy distributors 16B, 16C are not in the home position, other control circuits 90 supply an activating signal over line 100 to AND circuit 97 signifying that bidirectional collation is desired; i.e., next collate in the up direction. Finally, other control circuits 90 supply a signal over line 101 indicating that CPP 13 is in fact in the copy overlap mode; i.e., copies bearing images for more than one original document will be or are in the paper path in CPP 13 and the paper path extending to collators 14B, 14C. Finally, collate up latch 98 being set supplies a signal over line 102 to other control circuits 90 as well as to collator controls 91 for actuating the collators 14B, 14C to collate in the up direction.

Go home latch 103 signifies to collator controls 91 that the overlap mode is not present in CPP 13 in that add run latch 95 is reset. Go home latch 103 is set by AND circuit 104 in response to add run latch 95 being reset, the end of run signal during a collate mode on line 101 and last copy signal on line 120. Last copy is indicated as shown in U.S. Pat. No. 4,003,569. The go home latch 103 supplies its control signals over line 105 to collator controls 91 and to other control circuits 90.

In the operation of latches 95, 98 and 103, the add run latch 95 is set during a collate mode copy production run as soon as document 62 is inserted into tray 11B and actuates sensor 60 (sensor 61 in case of FIG. 3 embodiment). This corresponds to copy microprocessor 170 setting a flag bit in status registers 80 for indicating bidirectional collation some time before the end of run signal is received from CPP 13. Communication between other control circuits 90, collator controls 91, CPP 13, and input optics 12 is by cables 106, 107, 108, respectively.

Latches 95, 98, 103 are reset by control circuits 90 via a signal supplied over line 109 corresponding to a start signal for starting a new run, i.e., a new document has been placed on plate and glass 11A to be imaged via input optics 12 as scanned via the image path 12B. Similarly, the line 101 signal is supplied through OR circuit 110 to reset add run run latch 95 in preparation for detection of the next bidirectional collator function as initiated by the operator (not shown) inserting a document 62 onto tray 11B during a present copy production run.

Referring next to FIG. 5, detection of an end of copy run is shown. A copy select register CSR 110 maintains a selection received from panel 52 via cable 111 indicating the number of copies to be produced of each image. A copy count register CC 112 receives a signal generated within CPP 13 in a known manner and supplied over line 113 to increment CC 112 for indicating the number of copies being produced. CC 112 may be actuated at various times within the copy production cycle. One way to actuate CC 112 is by sensing paper picked from supplies 35, 54 or from duplex interim storage unit 40 is approaching aligner gate 28 over path 27 as indicated by a sensor 114 (FIG. 1). When the signal content of CC 112 and CSR 110 are equal, comparator 115 supplies an end of run signal over line 116 to other control circuits 90. During the collate mode, the end of run signal goes over line 101 as previously described.

In a computerized embodiment of FIG. 3, CSR 110, CC 112 are registers within memory 172, such as other status registers 80. Compare 115 is a branch instruction for comparing the signal contents of CSR 110 and CC 112 within status registers 80. Tallying or incrementing counter CC 112 is in response to the signal from sensor 114 actuating programs within copy microprocessor 170 denominated as other program 86.

While the invention has been particularly shown and described with reference to preferred embodiments thereof, it will be understood by those skilled in the art that various changes in form and details may be made therein without departing from the spirit and scope of the invention.

What is claimed is:

1. A copy production machine having an original document transport for positioning an original document in an imaging position, a cyclable copy production portion for producing copies of an original document in said imaging position, an output portion including a collator having relatively movable copy distributor and collator bins whereby relative movement therebetween effects a collation of copies produced by said copy production portion and having a home position and constructed to normally collate in an away from home direction, the improvement including in combination:

means in one of said portions indicating end of a copy producing run, means detecting an original document to be transported by said original document transport for indicating an immediate new copy run, and collator control means including a first means jointly responsive to said end of run indication to actuate said collator to relatively move said distributor and bins to said home position and a second means responsive to said immediate new run indication to override said first means actuation for actuating said collator to collate in a going home direction.

2. The invention set forth in claim 1 further including means limiting said immediate run indication to detection of original documents during a current copy producing run.

3. The invention set forth in claim 1 wherein further including a program controlled control element connected to said output portion, copy production portion and said original document portion for sensing status thereof and controlling same, a program element in said control element indicating control to be exercised in response to predetermined sensed status and including a program element portion constituting said collator control means.

4. The method of operating a copy production machine having a collator operable to collate in a first direction more reliably than a second direction opposite to said first direction, means for scanning an original document to be copied, the steps of:

indicating that copies from more than one image will be simultaneously in said copy production machine, collating copies in both said directions when said indication indicates copies from more than one image, and collating only in said first direction in the absence of said indication.

5. A program controlled copy production machine having an original document transport for positioning an original document in an imaging position, a cyclable copy production portion for producing copies of an original document in said imaging position, an output portion including a collator having relatively movable copy distributor and collator bins whereby relative movement therebetween effects a collation of copies produced by said copy production portion and having a home position, said collator being constructed to normally collate in an away-from-home direction, programmable control means connected to said original document transport, cyclable copy production portion and said output portion including said collator for sensing status thereof and for supplying control signals thereto, a program memory connected to said programmable control for containing data signals and control signals for enabling said programmable control means to operatively associate said status signals and said control signals in a predetermined manner for controlling said copy production machine including a program element for enabling said programmable control means to operatively associate a sensed original document transport indication that a copy is to be made with a sensed end-of-run indication from one of said portions to actuate said collator to collate in both directions and for actuating said collator to collate in said away-from-home direction in the absence of said original document transport indication.

6. A program controlled copy production machine having an original document transport for positioning an original document in an imaging position, a cyclable copy production portion for producing copies of an original document in said imaging position, an output portion including a collator having a relatively movable copy distributor and collator bins whereby relative movement therebetween effects a collation of copies produced by said copy production portion and having a home position, said collator constructed to normally collate in an away-from-home direction but operable to move in a going-home direction for collation in a less reliable manner than said going away-from-home direction, the improvement including in combination:

a computer means having an input portion and an output portion, both said portions connected to said original document transport cyclable copy production portion and said output portion including said collator for sensing status thereof and supplying control signals thereto, said original document transport including indicating means for indicating an original in a position to be transported to said imaging position, one of said portions indicating an end of a copy production run, said computer means including a program control memory having recorded control signals constituting a collator control program signifying to said computer to execute predetermined control functions with respect to said collator, said computer being responsive to said collator control program to, (a) actuate said collator to collate in both said going away-from-home and going-home directions whenever said original document transport indicates an original in said input position whenever said copy production portion simultaneously indicates end of run, and (b) actuate said collator to collate only in said going away-from-home direction in the absence of one of said indications.

7. The machine set forth in claim 6 further including means in said control means to actuate said control means to actuate said collator portion to relatively move said copy distributor and said bins in the absence of copy production to move to a reference relative position.

8. A copy production machine having a collator output portion and a copy production portion, said copy production portion capable of producing copies of a plurality of different images in a succession of copy producing runs wherein copies of one run are still in said copy production portion with copies for a next succeeding run and including means operative when said plurality of different images are in said copy production portion to indicate a so-called overlap mode, said collator portion having a relatively movable copy distributor and collator bins which in a single run collate occurs in a first relative direction, and control means responsive to said overlap indication to activate said collator to collate copies of immediately succeeding runs in alternating directions whereby relative motions of said copy distributor and bins are more efficiently used for copy distribution.

9. A copy production maching having a copy production portion and a collator portion, a programmable computer having a control memory portion and a working store portion, and input-output means connecting said computer to said copy production portion and said collator portion, said collator portion having a relatively movable copy distributor and a plurality of copy receiving portions, characterized in that:

means operatively associated with said computer to indicate a succession of copy producing runs, said control memory portion having a program element enabling said computer to respond to said run indication to actuate said collator portion to distribute copies by a succession of relative motions between said copy distributor and said copy receiving portions in alternating opposite directions and a further portion of said program element enabling said computer to actuate said collator portion to distribute copies only in a first one of said opposite directions whenever said succession of runs is not being indicated.

10. A copy production machine having a copy production portion and a collator output portion, the improvement comprising:

said copy production portion having means for processing a plurality of copies of a succession of images to be copied as a copy job, said collator output having means for receiving said copies to collate the received copies into a given number of collated sets of one copy job, said collator portion having relatively movable copy distributer and collator bins which collate copies in alternating directions to perform a copy job, means indicating an end to a copy job; and means responsive to said indication for activating said collator output portion to relatively adjust said copy distributer and collator bins in preparation for collating copies of another copy job without collating any copies.

* * * * *